United States Patent [19]

Richards

[11] 4,089,112

[45] May 16, 1978

[54] ADJUSTABLE BLADE KNIFE

[75] Inventor: James L. Richards, Rosemead, Calif.

[73] Assignee: Pacific Handy Cutter, Inc., Costa Mesa, Calif.

[21] Appl. No.: 728,300

[22] Filed: Sep. 30, 1976

[51] Int. Cl.[2] ..... B26B 1/08

[52] U.S. Cl. ..... 30/162; 30/320; 30/335

[58] Field of Search ..... 30/162, 320, 335

[56] References Cited

U.S. PATENT DOCUMENTS

| | | | |
|---|---|---|---|
| 336,112 | 2/1886 | Holdsworth | 30/162 X |
| 1,496,927 | 6/1924 | Evers | 30/162 |
| 1,906,573 | 5/1933 | Gits | 30/162 X |
| 1,960,130 | 5/1934 | Trubel | 30/162 X |
| 2,578,896 | 12/1951 | Moore | 30/162 X |
| 2,737,069 | 3/1956 | Weindel | 30/162 X |
| 2,754,584 | 7/1956 | Ferguson | 30/162 |
| 3,857,176 | 12/1974 | Quenot | 30/162 |
| 3,879,847 | 4/1975 | Roll | 30/162 |
| 3,906,627 | 9/1975 | Manning | 30/162 |

FOREIGN PATENT DOCUMENTS

| | | | |
|---|---|---|---|
| 531,248 | 8/1931 | Germany | 30/162 |

*Primary Examiner*—Gary L. Smith
*Assistant Examiner*—J. T. Zatarga
*Attorney, Agent, or Firm*—Poms, Smith, Lande & Glenny

[57] ABSTRACT

An adjustable blade knife is made by extruding a continuous strip of extrudable hardenable material with the strip having a planer web between thicker marginal portions and opposing slots in the marginal portions, individual knife handle bodies are stamped from the strip and a knife blade is assembled to each body by inserting the blade in the opposed slots of the body. The blade is preferably preassembled to a slide plate with the slide plate and blade positioned together in the handle body slots to slide along the web portion of the handle body which is provided with a longitudinally extending slot having at least one side wall of an irregular surface configuration to co-operate with positioning means provided on the slide plate to facilitate locating the blade-plate sub-assembly in adjustable positions of use.

1 Claim, 13 Drawing Figures

Fig. 1.
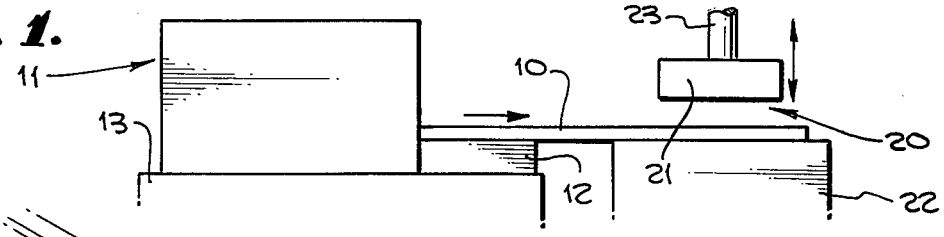
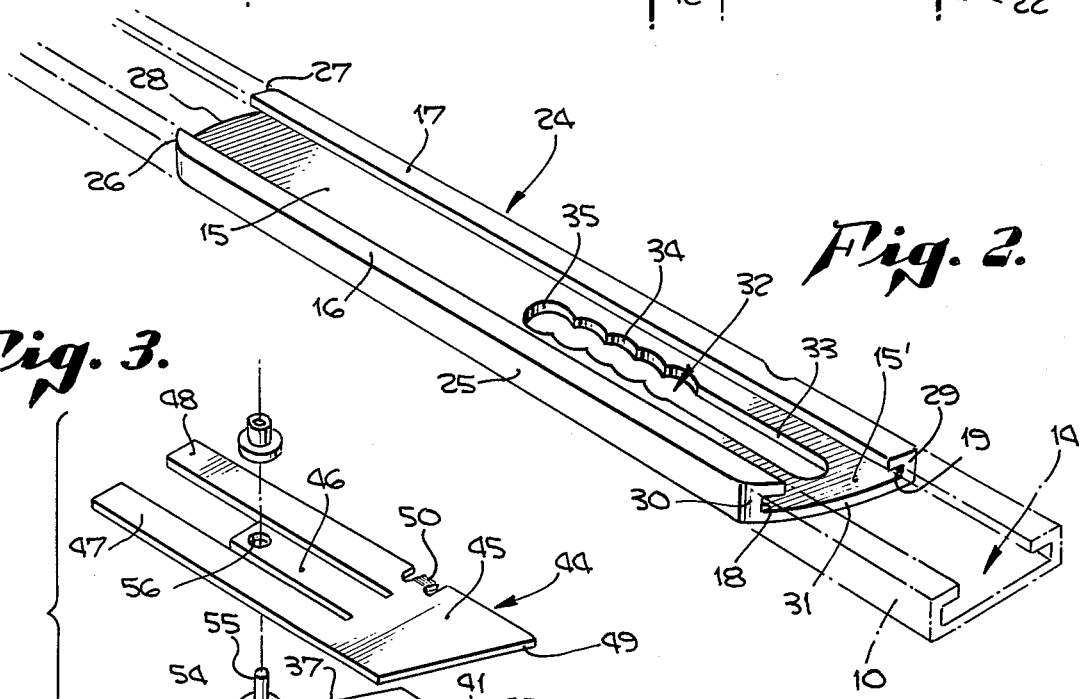
Fig. 2.
Fig. 3.
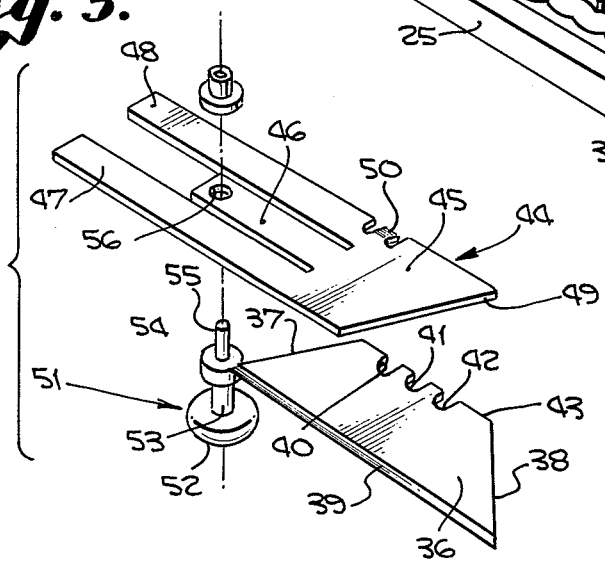
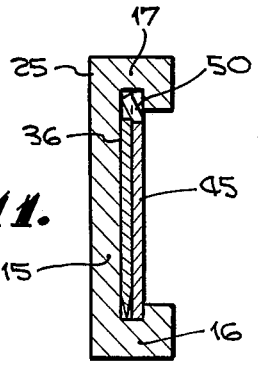
Fig. 11.
Fig. 12.
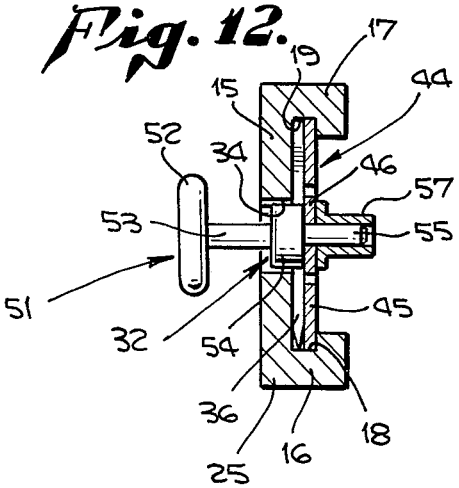
Fig. 13.
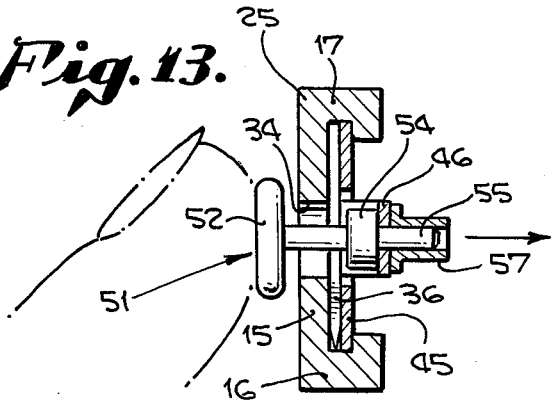

ADJUSTABLE BLADE KNIFE

BACKGROUND OF THE INVENTION

The present invention relates in general to adjustable blade knifes and more particularly to such knives wherein a cutting blade is slidable between fully withdrawn and various projected positions.

It has been common heretofore to manufacture adjustable blade knifes having a sheath or sleeve like body encasing a razorlike blade which is adjustable between withdrawn and projected positions relative to the surrounding body. The knife body or handle thus provided has generally been made through stamping sheet metal parts and bending them into a sheath or sleeve configuration to receive the flat cutting blade. Other knifes have been made through the assembly of a plurality of individually stamped or milled parts to provide an appropriate enclosure for the blade, it being desired that the cutting edge of the blade be fully enclosed within the protective handle or knife body when not in use.

I have recognized that it would be desirable to produce adjustable blade knifes in a more facile, less expensive and easier manner than employed in the prior metal working, milling and multiple part assembly operations employed heretofore. Specifically, I have found that an improved construction and method of making an adjustable blade knife is afforded through the use of an extruded knife handle or body which can be made in a one piece integral manner as hereinafter described.

SUMMARY OF THE INVENTION

It is therefore a primary object of the present invention to disclose and provide methods of manufacture and apparatus comprising an extruded material knife handle for an adjustable blade knife which can be quickly, inexpensively and easily manufactured.

It is another object to provide and disclose an improved method, and construction, of assemblying a cutting blade to an extruded knife handle body of the foregoing object and more specifically wherein a preassembly of slide plate and blade may be simply assembled to the knife handle body for adjustable positions of use.

Generally stated, the method of manufacturing of the adjustable blade knife of the present invention contemplates the steps of extruding a continuous strip of extrudable hardenable material with the strip having a planer web between thicker marginal portions and opposed slots in the marginal portions, stamping a plurality of individual knife handle bodies from the strip and then assemblying a knife blade to each body of the knife handle bodies by inserting a blade in the opposed slots of each of the bodies. In extruding the continuous strip to provide the opposed slots, it is preferred that a side wall of each slot be co-planer with an adjacent wall of the body web. A longitudinally extending slot is preferably stamped in the web of each handle body as well with at least one side wall of each slot having an irregular surface to co-operate with positioning means for positioning the blade.

As contemplated within the present invention, a stamped spring steel slide plate of generally planer configuration is positioned against the cutting blade in side by side preassembled condition, with detent means interengaging between the two and the subassembly of plate and blade is slid into the handle body slots to provide an assembled knife. According to the present method, the slide plate and blade subassembly is then positioned along the longitudinal extent of the extruded handle body by interengagements between a manually operable member on the slide plate and the aforementioned irregularities of the web slot side wall.

The adjustable blade knife thus provided, according to the invention and apparatus of the present invention, may thus comprise a knife handle body having a longitudinally extending planer web interconnected between integral marginal edge portions, opposed guide slots formed in the marginal edge portions on opposite sides of the web, slide means positioned in the slots for engaging and positioning the blade along the longitudinal extent of the body and positioning means for locking the slide means in a desired position on the handle to hold the blade in a desired position relative to the handle.

Additional objects, and various advantages, of the present invention in method of manufacturing adjustable blade knifes, and the apparatus of such adjustable blade knifes will become apparent to those skilled in the art from a consideration of the following detailed explanation of a preferred exemplary embodiment thereof. Reference will be made to the appended sheets of drawings which will be first described briefly.

BRIEF DESCRIPTION OF THE DRAWINGS

FIG. 1 is a schematic representation of an extruding operation employed in the method of manufacturing a plurality of adjustable blade knifes in accordance with the present invention;

FIG. 2 is a perspective view of a knife blade handle stamped from an extruded strip of hardenable material according to the method and apparatus of the present invention;

FIG. 3 is an exploded view of a slide plate and cutting blade assembly construction for assembly to the knife handle of FIG. 2 in accordance with the method and apparatus of the present invention;

FIG. 11 is a section view of the knife of FIG. 9 taken therein along the plane XI—XI;

FIG. 12 is a section view of the knife of FIG. 9 taken therein along the plane XII—XII; and FIG. 13 is a view as in FIG. 12 showing a manual operation of a portion of the knife to adjust the position of the blade relative to the handle.

DETAILED DESCRIPTION OF THE PREFERRED EXEMPLARY EMBODIMENT

Figure 4:
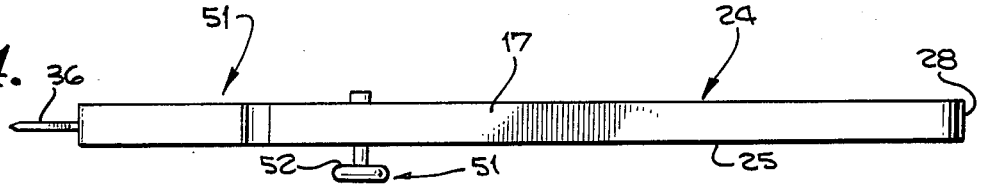
FIG. 4 is a top view of a preferred exemplary embodiment of adjustable blade knife according to the method and apparatus of the present invention.

A preferred exemplary embodiment of adjustable blade knife, according to the present invention, is illustrated in FIGS. 4 through 13 with its preferred method of manufacture, in accordance with the present invention, being illustrated in FIGS. 1 through 3. According to the present method, a plurality of adjustable blade knifes are preferably manufactured through the steps of initially extruding a continuous strip 10 of an extrudable hardenable material, preferably aluminum, from a conventional extrusion die, indicated generally at 11 which extrudes strip 10 onto a platen 12 situated adjacent die 11 on base 13. As is particularly contemplated within the present invention, strip 10 is preferably extruded of aluminum material in a continuous strip having a continuous longitudinally extending recess, indicated generally at 14 in FIG. 2, forming a planer web 15 with marginal edge portions 16 and 17 which have thicker dimensions in a direction perpendicular to the plane of web 15 than the thickness of web 15 as seen in FIG. 2.

As further contemplated within the method and apparatus of the present invention, strip 10 is extruded in continuous strip form with a pair of opposed slots, as slots 18 and 19 in FIG. 2 in the marginal edge portions 16 and 17, respectively, and along opposite sides of the recess indicated generally at 14. Preferably, slots 18 and 19 each have longitudinally extending side wall which is co-planer, and in the exemplary embodiment integral and continuous with, the upper surface 15' of web 15.

As strip 10 is extruded from the extrusion die 11, it may be passed directly, or indirectly, to a stamping die, indicated generally at 20, which includes an upper die member 21 mounted for vertical reciprocation relative to lower die member or platen 22 via shaft 23 associated with a conventional stamping die or press apparatus. As particularly contemplated within the present invention, die 21 is provided to stamp a knife handle, indicated generally at 24 in FIG. 2, of a finished configuration as seen in FIG. 2 in a single stroke of the die. As seen in FIGS. 2, 5, 9 and 10, the knife handle, indicated generally at 24 is preferably stamped as a one piece, integral body 25 having rounded or radiused rear corners 26 and 27 at rear end 28 and rounded forward corners 29 and 30 at forward end 31. A longitudinally extending slot, indicated generally at 32 is also formed during the single stroke of the die 21 in a forward portion of web 15 in each of the handle bodies 25 as they are stamped from strip 10 as seen in FIG. 2. Such slot means, indicated generally at 32, thus provide an aperture through web 15 comprising in the exemplary embodiment a forward longitudinally extending slot portion 33 and a rearward slot portion 34 having irregular sidewalls formed by a plurality of circular sections, as section 35, interconnected to one another to facilitate locating the knife blade in body 25 as hereinafter explained.

As can be seen from the foregoing, a plurality of adjustable blade knife handles, as the handle indicated at 24 in FIG. 2, may be quickly and inexpensively manufactured in a mass production type operation from a single continuous strip of extruded material as hereinbefore described. Through a single stamping operation, each handle body, as body 25 in FIG. 2, is a completed, finished one-piece integral handle. By positioning strip 10 beneath die 21 with recess 14 facing upwardly, as seen in FIGS. 1 and 2, the single stamping operation can be quickly and effectively accomplished stamping individual handle bodies out of successive portions of strip 10 as it is advanced by known means beneath upper die member 21. Individual knife bodies 25 may then be utilized in assemblying the completed adjustable blade knife, in accordance with the present invention, as hereinafter explained.

Referring now to FIG. 3, an exemplary embodiment of blade 36 is illustrated which has outwardly tapered sidewalls 37 and 38 terminating in a longitudinally extending cutting edge 39. A plurality of notches 40, 41 and 42 are illustrated in an upper edge 43 of blade 36 as are available in conventionally available cutting blades. As is particularly contemplated within the present invention, blade 36 is preassembled to a slide plate, indicated generally at 44, with the assembly of slide plate and blade then being assembled to handle body 25 via slots 18 and 19. The exemplary embodiment of slide plate, indicated generally at 44, is preferably stamped from a suitable spring steel to have a flat, generally planar, body 45 with a rearwardly extending central spring arm 46 formed between plate rear portions 47 and 48. A forward edge 49 of plate body 45 may be cut on a bias to generally conform to the configuration of the forward end 31 of handle body 25. A first detent 50 is formed integrally of body 45 during stamping of the slide body 45 for engagement with any one of the notches 40, 41 or 42 of blade 36 when the plate and blade are assembled together. Detent 50 comprises a tab portion of body 45 which is stamped free of the body along its marginal side portions and bent laterally of body 45, as seen in FIG. 11, to engage in the blade notches to hold blade 36 against movement longitudinally of slide plate 44 when they are assembled to the handle body 25.

Positioning detent means are also provided in association with the springable arm 46 of slide plate 44, in accordance with the present invention, for resiliently and releasably engaging with any one of the positioning or locating portions 34 of the handle aperture indicated generally at 32 to facilitate manual adjustment and locating of blade 36 along the longitudinal extent of the handle between a fully withdrawn and selected exposed positions for blade 36. As seen in FIG. 3, the exemplary embodiment of detent means includes a manually operable member, indicated generally at 51, including botton 52 mounted on stem 53. A locating detent 54, of circular configuration, is also provided on stem 53, the stem having a reduced diameter portion 55 adapted to fit through aperture 56 formed in spring arm 46. A fastening means, as rivet 57, is provided for holding the member 51 to arm 46.

Figure 5:
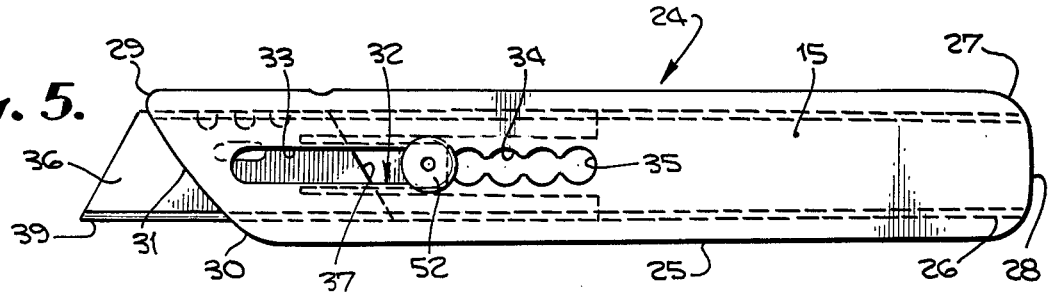
FIG. 5 is a front view of the knife of FIG. 4.
Figure 6:
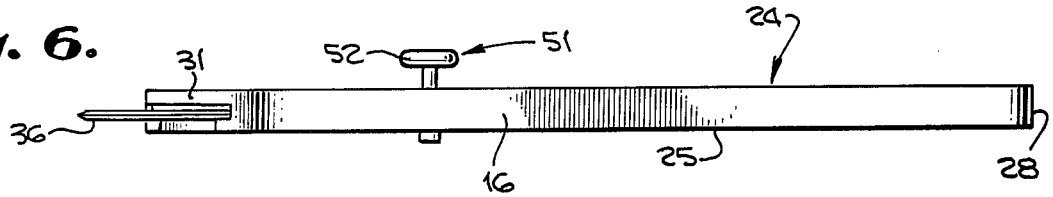
FIG. 6 is a bottom view of the knife of FIGS. 4 and 5.
Figure 7:
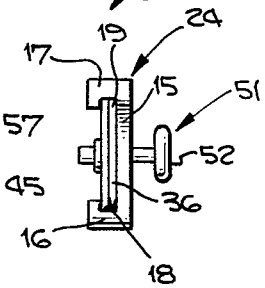
FIG. 7 is a front view of the knife of FIGS. 4 through 6.
Figure 8:
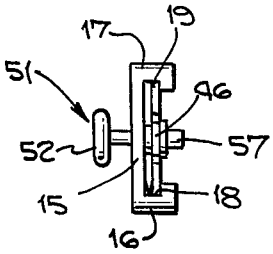
FIG. 8 is a rear view of the knife of FIGS. 4 through 7.
Figure 9:
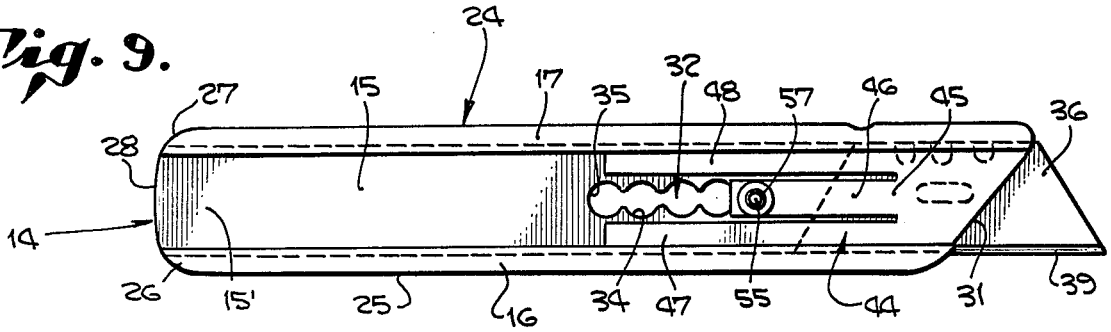
FIG. 9 is a rear view of the exemplary knife of FIGS. 4 through 8.

According to the method and apparatus of the present invention, the slide plate body 45, as seen in FIG. 3, and blade 36 are first assembled in a preassembly to one another and are slide into the opposing slots 18 and 19 of handle body 25 as seen in FIG. 11. With the preassembly of slide plate 44 and blade 36 thus assembled to body 25, the manual member 51 is then assembled to spring arm 46 and secured thereto by rivet 57 to provide the assembly as seen in cross section in FIG. 12. Upper and lower marginal edge portions of the assembled blade 36 and slide plate body 45 fit snugly within slots 18 and 19 for sliding movement longitudinally of the knife handle 25. As seen in FIG. 12, positioning detent 54 is seated within one of the circular sections of the locating portion 34 of the slot means, indicated generally at 32, in body 25 positioning the knife blade in a position of intended use as seen in FIGS. 5 and 9.

Figure 10:
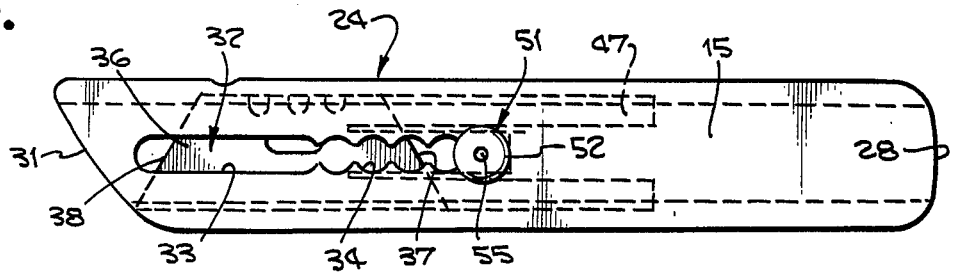
FIG. 10 is a front view of the exemplary knife of FIGS. 4 through 9 showing the blade adjusted to a fully withdrawn position.

As can be seen from the foregoing, the subassembly of slide plate, indicated generally at 44, and blade 36 may be withdrawn within handle body 25 as seen in FIG. 10 through a depression of manually operable member 51, as seen in FIG. 13, and sliding the subassembly within handle body 25 to the right in FIG. 10 positioning the detent 54 in the rear circular section 35 of the slot indicated generally at 32. Blade 36 may then be adjusted for varying amounts of exposure from handle body 25 by positioning the detent 54 in any one of the other positioning sections of slot portion 34 to the forward position of FIGS. 5 and 9. When it is necessary to change blade 36 the blade and slide plate may be moved more forwardly of handle body 25 than the positions of FIGS. 5 and 9 by depressing operator member 51 as seen in FIG. 13 and sliding the plate-blade subassembly forwardly to place positioning detent 54 into the forward slot portion 33 and thus move blade 36 entirely out the forward end 31 of the handle body 25. On placing a new blade on to the slide plate 44, which remains assembled to the handle body 25, the new blade is engaged with the plate detent 50 and the plate and blade are slid rearwardly into slots 18 and 19 of the handle body as aforedescribed with the blade thereafter being positionable between the positions of FIGS. 9 and 10 as desired.

Having thus described a preferred exemplary embodiment of adjustable blade knife construction, and the method of making the same, according to the present invention, it should be understood by those skilled in the art that various modifications, alternative embodiments and various equivalents thereof may be made within the scope of the present invention which is defined by the following claims.

I claim:

1. An adjustable blade knife comprising:

a one piece handle having a continuous longitudinally extending recess forming a web portion between marginal edge portions of thicker dimension then that of said web:

a pair of opposed slots formed in said handle along opposite sides of said recess in said edge portions with each slot having a side wall adjacent and coplanar to a side wall of said web;

an assembly of slide plate and cutting blade in side-by-side interconnected relation and positioned in said recess with marginal portions of said plate and blade assembly extending into each of said slots, respectively, and being guided along said handle thereby; and positioning means comprising a slot formed in said web of said handle, said slot comprising a continuous slot having a first rectangular portion connected to a second portion comprising a plurality of overlapping and interconnected circular slot portions. a spring arm formed integrally of said slide plate, cam means on said arm for fitting said circular slot portions, and a manually operable member operable from the side of said handle opposite said slots and connected to said arm for selectably depressing said arm away from the handle side having said slots out of engagement with said slot portions to adjust the position of said slide and blade assembly relative to said handle.

* * * * *